United States Patent [19]

Battersby et al.

[11] 4,188,013

[45] Feb. 12, 1980

[54] GAS VALVE SEATING MEMBER

[75] Inventors: Robert J. Battersby, San Pedro; Paul Dietiker, Redondo-Beach, both of Calif.

[73] Assignee: Honeywell Inc., Minneapolis, Minn.

[21] Appl. No.: 822,978

[22] Filed: Aug. 8, 1977

[51] Int. Cl.[2] ..... F16K 1/34

[52] U.S. Cl. ..... 251/175; 251/210; 251/333

[58] Field of Search ..... 251/210, 333; 137/614.11

[56] References Cited

U.S. PATENT DOCUMENTS

| | | | |
|---|---|---|---|
| 660,995 | 10/1900 | Murray | 137/310 |
| 2,218,871 | 10/1940 | Broden | 251/333 |
| 2,387,653 | 10/1945 | Elliott | 303/54 |
| 2,403,777 | 7/1946 | Yanka | 251/333 X |
| 2,413,571 | 12/1946 | Krone et al. | 137/614.03 |
| 2,429,984 | 11/1947 | Berglund | 137/859 |
| 2,731,036 | 1/1956 | Hughes | 137/625.34 |
| 2,902,249 | 9/1959 | Meusy | 251/333 X |
| 2,979,643 | 4/1961 | DeWilde et al. | 317/199 |
| 3,125,121 | 3/1964 | Muller | 137/614.11 |
| 3,354,901 | 11/1967 | Dietiker et al. | 137/495 |
| 3,398,890 | 8/1968 | Fleer | 236/15 |
| 3,409,039 | 11/1968 | Griffin | 137/516.29 |
| 3,575,197 | 4/1971 | Ray | 137/312 |
| 3,722,852 | 3/1973 | Powell et al. | 251/333 X |
| 3,877,475 | 4/1975 | Dietiker | 137/66 |

FOREIGN PATENT DOCUMENTS

| | | |
|---|---|---|
| 192973 | 2/1923 | United Kingdom . |
| 1332877 | 10/1973 | United Kingdom . |

*Primary Examiner*—Arnold Rosenthal
*Attorney, Agent, or Firm*—Clyde C. Blinn

[57] ABSTRACT

A gas valve has a valve seating surface and flexible valve member to insure that the gas flow is terminated when the valve closes. The valve seating surface has a flat portion around an opening and a raised portion around the peripheral opening. A cooperating flexible valve member has a flat portion and a raised portion around its periphery. When the flexible valve member moves against the seating surface, the raised portion of the flexible valve member engages the flat portion of the seating surface and the raised portion of the seating surface engages the flat portion of the valve member to form two concentric series connected seals to insure that gas flow through the valve is terminated.

1 Claim, 4 Drawing Figures

GAS VALVE SEATING MEMBER

BACKGROUND AND SUMMARY OF THE INVENTION

Figure 1:
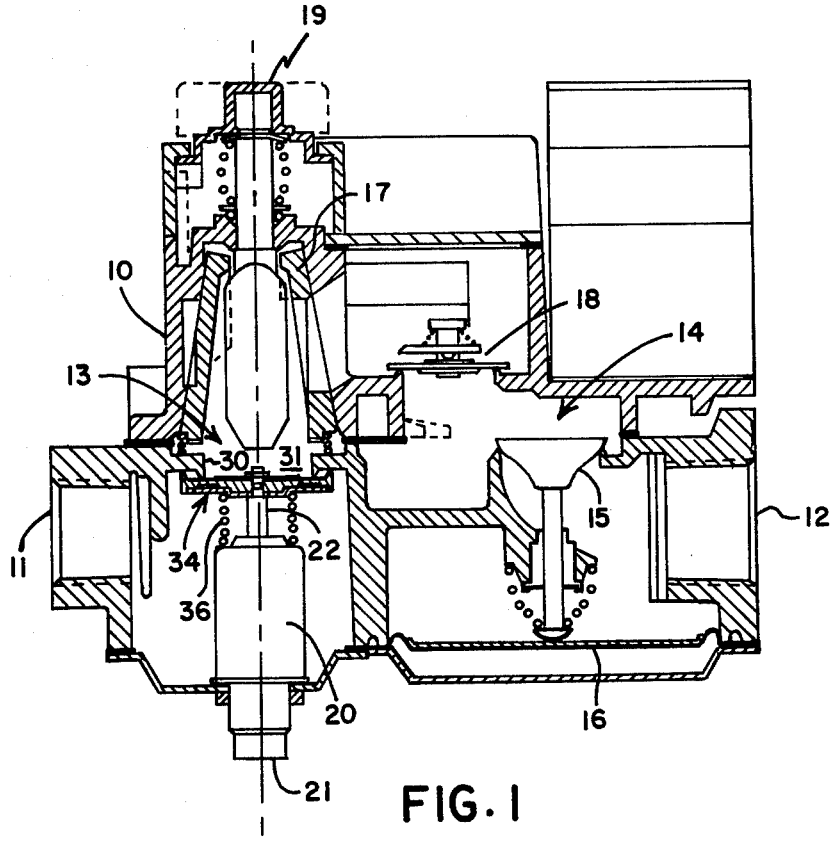

While the design of gas valves has always had the concern of disastrous conditions taking place if leakage occurs, with the advent of extreme product liability and a greater concern for personal safety, there is a continuous endeavor to make gas valves so that when the safety portion of the gas valve closes, gas flow is absolutely terminated. As gas valves of this type generally set for a number of years in an open position, especially if the pilot burner is maintained on throughout the summer, a design for a gas valve to insure that there is an adequate seal should the safety valve close at any time is a necessity.

The present invention is concerned with a dual sealing surface valve to insure adequate termination of gas flow without the expense of two series connected gas valves for redundant safety. Specifically, the valve seating surface and the valve member engage to form two concentric sealing rings or surfaces by having a valve seating surface that has a flat portion and a raised portion concentric of the opening and a flexible valve member which has a flat surface and a raised portion on its outer periphery. When the flexible valve member engages the seating surface, the raised portions engage the respective flat portions to form the two concentric series sealing surfaces to prevent gas flow through the passageway.

The embodiments of the invention are shown in the drawing as

Figure 2:
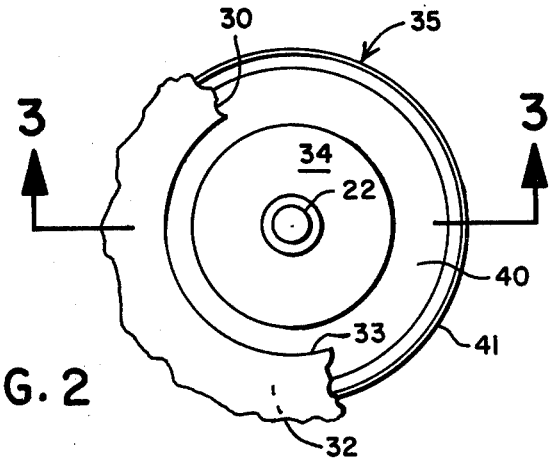
Figure 4:
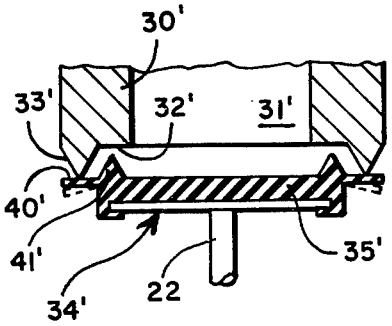
Figure 3:
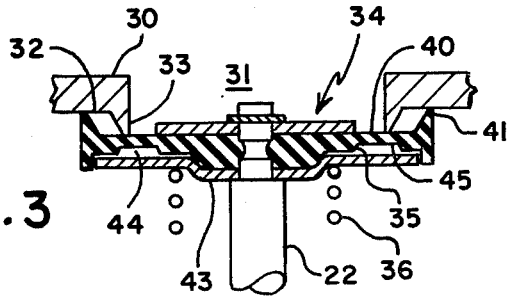

FIG. 1 is a cross sectional view of a valve with the seating surface and valve member in a closed position, FIG. 2 is a vertical view of the seat and valve member, FIG. 3 is a side cross sectional view of the valve, FIG. 4 is a second embodiment of the valve.

DESCRIPTION OF THE INVENTION

Referring to FIG. 1, a gas valve has a body 10 having an inlet opening 11 for connecting the gas valve to a source of gas under pressure and an outlet opening 12 for connecting the gas valve to a gas burning apparatus such as a furnace. The gas valve has a safety valve 13 and an automatic control portion 14. The automatic control portion has a valve member 15 controlled by a flexible diaphragm 16 to maintain an adequate flow of gas from the outlet by a pressure regulator or automatic control means (not shown) such as disclosed in the Paul Dietiker et al U.S. Pat. No. 3,354,901 issued Nov. 28, 1967. When the safety valve 13 is open, gas flows through a manually operated plug valve 17, a solenoid operated valve 18, the automatic control valve 15 to the outlet. Plug valve 17 is operated by turning a knob 19.

Safety valve 13 has an electromagnet 20 which connected at 21 to a thermocouple. Upon energization of the electromagnet by heating the thermocouple, an armature attached to shaft 22 and moved against a magnet by the downward manual operation of reset button or knob 19, holds the safety valve in an open position to allow gas flow through the passageway. Such a thermocouple operated safety valve is quite conventional and is disclosed in the Paul Dietiker U.S. Pat. No. 3,877,475 issued Apr. 15, 1975.

As also shown in FIGS. 2 and 3, safety valve 13 has a valve seating surface 30 which surrounds an opening

31 in the passageway between the inlet and outlet. The seating surface 30 has a flat portion 32 around the opening and a concentric raised portion or lip 33 in close proximity to the flat portion 32 around the periphery of the opening.

A valve member 34 which is attached in a conventional manner to shaft 22, cooperates with seating surface 30. Valve member 34 has a flexible portion or member 35 made of rubber or suitable flexible material which has a concentric flat portion 40 and a concentric raised portion or lip 41 about its periphery. The flexible member or rubber disc 35 is held on shaft 22 and backed by member 43. A space 44 is provided between the metal disc 43 and the flexible valve member 40 by an indent or groove 45 in the valve member 35 to allow for adjustment of the position of the flat portion of the valve member 40 when engaging raised portion 33 of the seating surface to insure a seal all around raised portion 33.

When valve member 34 moves upward by the force of a compression spring 36 to close the safety valve 13 upon the de-energization of electromagnet 20, the raised portion 41 engages the surface 32 and the raised portion 33 engages the flexible surface 40 which will bend to accomodate for variations in the tolerance and irregularities or the possibility of foreign particles existing on the sealing surfaces. With the closure of the valve member 34, two concentric rings of sealing surface are provided to provide a two series sealing of the safety valve 13.

Another embodiment of the valve is shown in FIG. 4. Seating surface 30' has a flat portion 32' adjacent the opening 31' and a lip or raised portion 33' beyond surface 32'. Valve member 34' has a lip 41' and a flat surface or flange 40' beyond the lip adjacent the outer periphery. Portion 40' flexes or bends away to allow proper seating all around between lip 33 and the flange to provide two concentric sealing surfaces between lip 41' and surface 32' and lip 33' and surface 40' when valve member 35 is moved upward by shaft 22' in a manner as previously described in connection with the valve of FIG. 1. The flexing or bending of flange 40' when engaged by lip 33' tends to wipe the surface of flange 40' to insure an adequate seal all around the periphery of said valve seating member.

The embodiments of the invention in which an exclusive property or right is claimed are defined as follows:

1. A gas valve comprising a valve body having an inlet opening adapted to be connected to a source of gas under pressure, an outlet opening adapted to be connected to a gas burning apparatus, and a passageway through the body interconnecting said inlet opening and said outlet opening, a valve seating surface around an opening forming said passageway between said inlet opening and said outlet opening, said valve seating surface having a flat portion around a periphery of said opening with a first lip in close proximity to said flat portion, said lip surrounding said opening and projecting in a first direction parallel to a center of said opening, and a flexible valve member attached to a shaft for movement of said valve member, said valve member having a second lip around its periphery, said second lip of said valve member projecting opposite said first direction, said valve member having a flat surface intermediate said second lip and said shaft whereby upon said valve member engaging said valve seating surface, said first lip of said valve seating surface engages said flat surface of said valve member and said second lip of said valve member engages said valve seating surface adjacent its projecting lip when closing so that two series gas flow seals are provided when said valve member is moved against said valve seating surface, said flexible valve member has a rigid backing member and a space between the back side of the flat surface of said flexible valve member and said rigid backing member to allow for movement of the flat surface of said valve member when engaged by said first lip of said valve seating surface upon closure of said valve member to provide a seal between said first lip of said seating surface and said valve member all around the surface of said first lip, said flexible valve member has inlet gas pressure on its back side to force said second lip against said flat portion of said valve seating surface and said flexible flat surface of said valve member against said first lip to provide said two series seals against gas flow through said passageway.

* * * * *